United States Patent [19]

Hong

[11] Patent Number: 4,996,921

[45] Date of Patent: Mar. 5, 1991

[54] STRUCTURE OF STAMP WITH SELF-PROVIDED INK FILLING MECHANISM

[76] Inventor: Chau-Kong Hong, No. 2-2, Liao Ning First St., Kaohsiung, Taiwan

[21] Appl. No.: 475,537

[22] Filed: Feb. 6, 1990

[51] Int. Cl.[5] ..... B41K 1/40

[52] U.S. Cl. ..... 101/333; 101/327

[58] Field of Search ..... 101/327, 333, 125

[56] References Cited

U.S. PATENT DOCUMENTS 2,316,040 4/1943 Wirafel ..... 101/327

3,885,495 5/1975 Funabashi ..... 101/327

FOREIGN PATENT DOCUMENTS 159388 9/1984 Japan ..... 101/333

162684 8/1985 Japan ..... 101/327

*Primary Examiner*—Edgar S. Burr

*Assistant Examiner*—Ren Yan

*Attorney, Agent, or Firm*—Varndell Legal Group

[57] ABSTRACT

An implement for imprinting mark, which includes a stamp holder for holding a stamp, an ink holder for containing ink and being fastening in the stamp holder. An ink hole is made on the division board portion of the ink holder for passing therethrough of ink from the ink holder. A pintle nozzle is fastening in the stamp with its top end disposed in the ink hole permitting the ink to fill the stamp with ink for imprinting when the stamp is brought forcibly against something to mark.

1 Claim, 2 Drawing Sheets

FIG 1

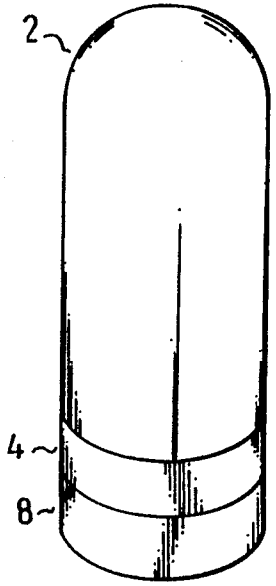
FIG 3
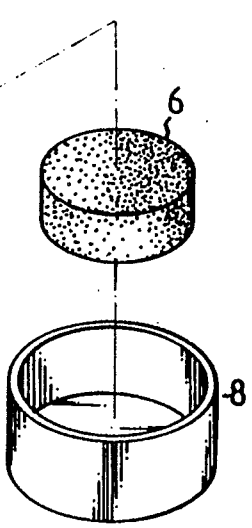
FIG 1
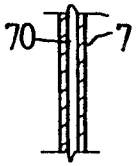
FIG 2
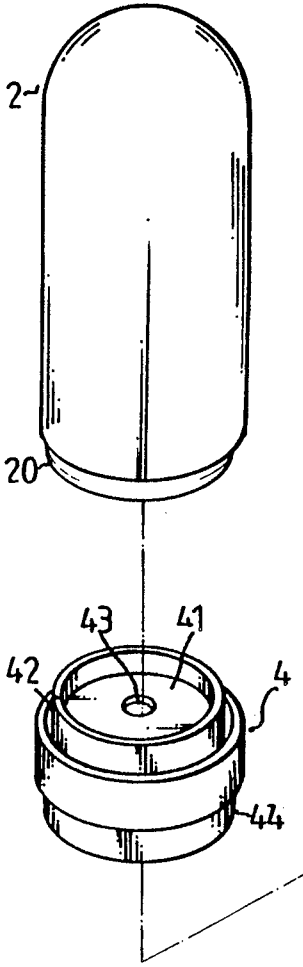

STRUCTURE OF STAMP WITH SELF-PROVIDED INK FILLING MECHANISM

BACKGROUND OF THE INVENTION

The present invention relates to stamps and more particularly to a stamp which has a self-provided ink filling mechanism to automatically fill the stamp with ink for imprinting.

For the imprinting of a seal, chop or rubber stamp, an ink pad or the like is generally required to provide a seal, chop or rubber stamp with ink. A separate ink pad or the like is inconvenient to carry with oneself. When an ink pad gets dried, it must be filled with fresh ink again. In use with a conventional ink pad or the like, a clear and uniform imprint of a seal, chop or rubber stamp on a paper is generally difficult to achieve, and the imprint may disperse on a paper. Further, the ink on a seal, chop or rubber stamp may cause contamination if it is not immediately cleared each time after imprinting.

The present invention is to provide a device for imprinting, which has various features as outlined hereinafter.

(A): A pintle nozzle is used to induce ink from an ink holder into a stamp to immerse the inner structure of the stamp such that clear mark can be achieved during imprinting;

(B): A top hole is made on an ink holder sealed by a rubber seal and secured by a releasable cap so that stamping ink can be refilled into the ink holder when it is required;

(C): For a stamp in bigger size, two or more pintle nozzles can be used to uniformly induce ink into the inner structure of such a stamp to secure clear imprinting;

(D): No ink pad is required; and (E): Contamination of a stamp can be efficiently eliminated.

BRIEF DESCRIPTION OF THE DRAWINGS

FIG. 1 is a fragmentary perspective view of stamp in accordance with the present invention;

FIG. 2 is an enlarged sectional view of a pintle nozzle according to the present invention;

FIG. 3 is a perspective assembly view of a stamp embodying the present invention;

DETAILED DESCRIPTION OF THE PREFERRED EMBODIMENTS

Figure 7:
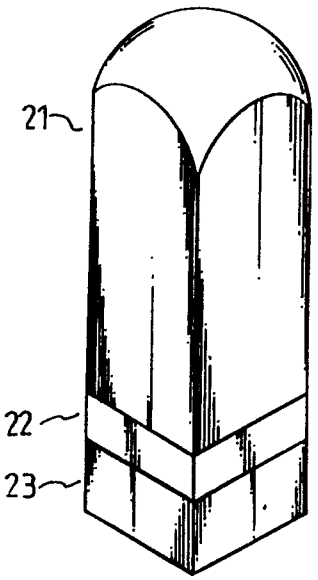
FIG. 7 is a perspective schematic view of another alternate form of the present invention.

Turning now to the annexed drawings in greater detail and referring first to FIG. 1, there is illustrated a cylindrical stamp holder 4 having a division board portion 41 dividing an upper chamber and a lower chamber. A round hole 43 is made on the division board portion 41 permitting the communication of the upper chamber of the stamp holder 4 with the lower chamber. A circumferential channel 42 is externally made on said division board of the cylindrical stamp holder 4. A hollow ink holder 2 has a bottom circular projecting end 20 inserted in the circumferential channel 42 of the cylindrical stamp holder 4 and fixedly secured therein by means of ultrasonic welding process. A stamp 6 which has a mark or characters engraved thereon for imprinting is firmly received in the lower chamber of the stamp holder 4. A pintle nozzle 7 which has an ink hole 70 (see FIG. 2) through its central axis is fastened in the stamp 6 with its one end embedded in the stamp 6 and its opposite end disposed in the round hole 43 of the division board portion 41 of the stamp holder 4. A cap 8 is provided for connection with the circular bottom projection 44 of the ink holder 2 to cover the stamp 6 inside the stamp holder 4, which can be conveniently removed from the stamp holder 4 during imprinting.

Figure 5:
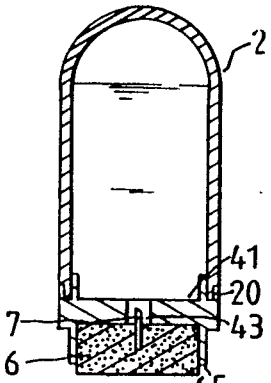
FIG. 5 is a schematic drawing, illustrating the use of the present invention.

Referring to FIG. 5, when the stamp 6 is brought forcibly against a paper or something by means of the ink holder 2 during imprinting, the stamp 6 retreates in the stamp holder 4 permitting the bottom edge 45 of the stamp holder 4 to press against such a paper. Because the bottom end of the ink hole 70 is disposed at a level higher than the bottom edge 45 of the stamp holder 4, the pintle nozzle 7 is protected against damage. According to the present invention, the stamp 6 is made of flexible material having a porous structure. Therefore, when the stamp 6 is brought forcibly against something, a certain amount of air is forced to penetrate into the inner chamber of the hollow ink holder 2 which forces the ink therein to flow through the ink hole 70 of the pintle nozzle 7 to uniformly fill the stamp 6 with ink for imprinting.

Figure 6:
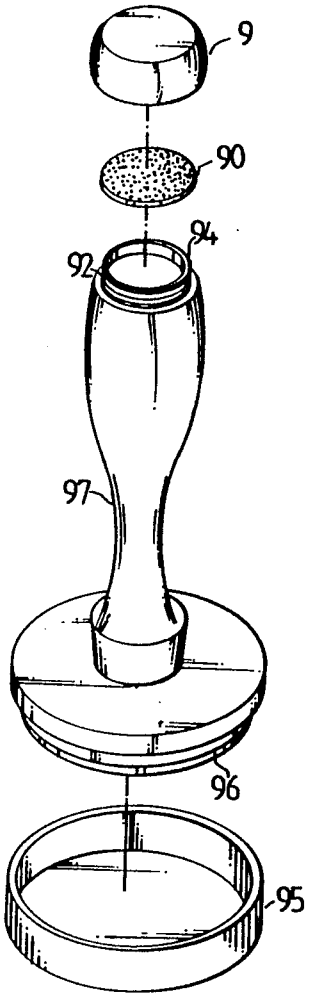
FIG. 6 is a fragmentary perspective view of an alternate form of the present invention.
Figure 4:
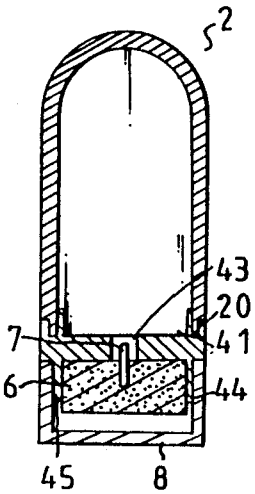
FIg. 4 is a sectional elevation of a stamp according to the present invention.

Referring to FIG. 6, therein illustrated is an alternate form of the present invention and generally comprised of an ink holder 97, a stamp 96, and a cover 95. The inner structure of the ink holder 97 and the stamp 96 is just the same as the foregoing first embodiment of the present invention as illustrated in FIG. 4. The structural difference of the embodiment of FIG. 6 is that the ink holder 97 is a combination of an ink holder and a stamp holder made through a shape molding process in an unitary piece having a circular upper projecting end 92 which has an outer thread 94 thereon for the connection thereto of a cap 9 through screwjoint, with a rubber seal 90 squeezed in therebetween to enclose the top opening of the ink holder 97. The cap 9 can be removed from the ink holder 97 for the filling of ink into the ink holder 97.

With reference to FIG. 7, therein illustrated is still another alternate form of the present invention, which has a structure same as the first embodiment of the present invention as illustrated in FIGS. 1 through 5. The only difference is its outer configuration. In this embodiment, the stamp is comprised of a square ink holder 21, a square stamp holder 22 and a square stamp 23.

I claim:

1. A device for imprinting a mark, including:

a stamp holder having an upper chamber and a lower chamber and a division board portion, said division board portion dividing said upper chamber and said lower chamber, said division board portion having a round hole therein permitting communication between said upper chamber and said lower chamber, and a circumferential channel externally made in said division board portion;

an ink holder for containing stamping ink, comprising a bottom circular projecting end inserted in said circumferential channel of said division board portion, said circular projecting end being fixed secured in said circumferential channel by means of ultrasonic welding;

a stamp having a mark or characters emgraved thereon for imprinting, said stamp being firmly secured in said lower chamber of said stamp holder;

a pintle nozzle having an ink hole through its central axis and having two ends, one of said ends being embedded and fastened in said stamp, the other of said two ends being disposed in said round hole of said division board portion of said stamp holder; and a cover for covering the end of the lower chamber of said stamp holder to protect said stamp.

* * * * *